United States Patent [19]

Bergmann

[11] 4,394,598

[45] Jul. 19, 1983

[54] SPARK PLUG FOR INTERNAL COMBUSTION ENGINES

[75] Inventor: Horst Bergmann, Esslingen, Fed. Rep. of Germany

[73] Assignee: Daimler-Benz Aktiengesellschaft, Stuttgart, Fed. Rep. of Germany

[21] Appl. No.: 211,901

[22] Filed: Dec. 1, 1980

[30] Foreign Application Priority Data

Nov. 29, 1979 [DE] Fed. Rep. of Germany ..... 2948043

[51] Int. Cl.[3] ..... H01J 5/48; H01T 13/04

[52] U.S. Cl. ..... 313/51; 313/135

[58] Field of Search ..... 313/135, 51, 118

[56] References Cited

U.S. PATENT DOCUMENTS

| | | | |
|---|---|---|---|
| 1,302,319 | 4/1919 | Cronin | 313/135 X |
| 1,667,661 | 4/1928 | Grasley | 81/121 R |
| 3,076,113 | 1/1963 | Candelise | 313/135 |
| 3,697,796 | 10/1972 | Livingston | 313/135 X |

FOREIGN PATENT DOCUMENTS

| | | | |
|---|---|---|---|
| 497757 | 11/1953 | Canada | 313/135 |

*Primary Examiner*—Alfred E. Smith

*Attorney, Agent, or Firm*—Craig & Burns

[57] ABSTRACT

A spark plug for internal combustion engines, especially a spark plug deeply arranged in a spark plug recess of the engine. The spark plug includes a mounting portion, a center electrode, and an insulating body. An extension arrangement is adapted to be attached to the spark plug for facilitating access thereto. The extension arrangement includes a center electrode, an insulating body, and a tubular jacket. The tubular jacket is provided at a first end with an inner cross section corresponding to a cross section of the mounting portion of the spark plug, with the inner cross section being adapted to be mounted over the mounting portion of the spark plug. A second end of the tubular jacket is provided with a further mounting portion.

11 Claims, 2 Drawing Figures

SPARK PLUG FOR INTERNAL COMBUSTION ENGINES

Figure 1:
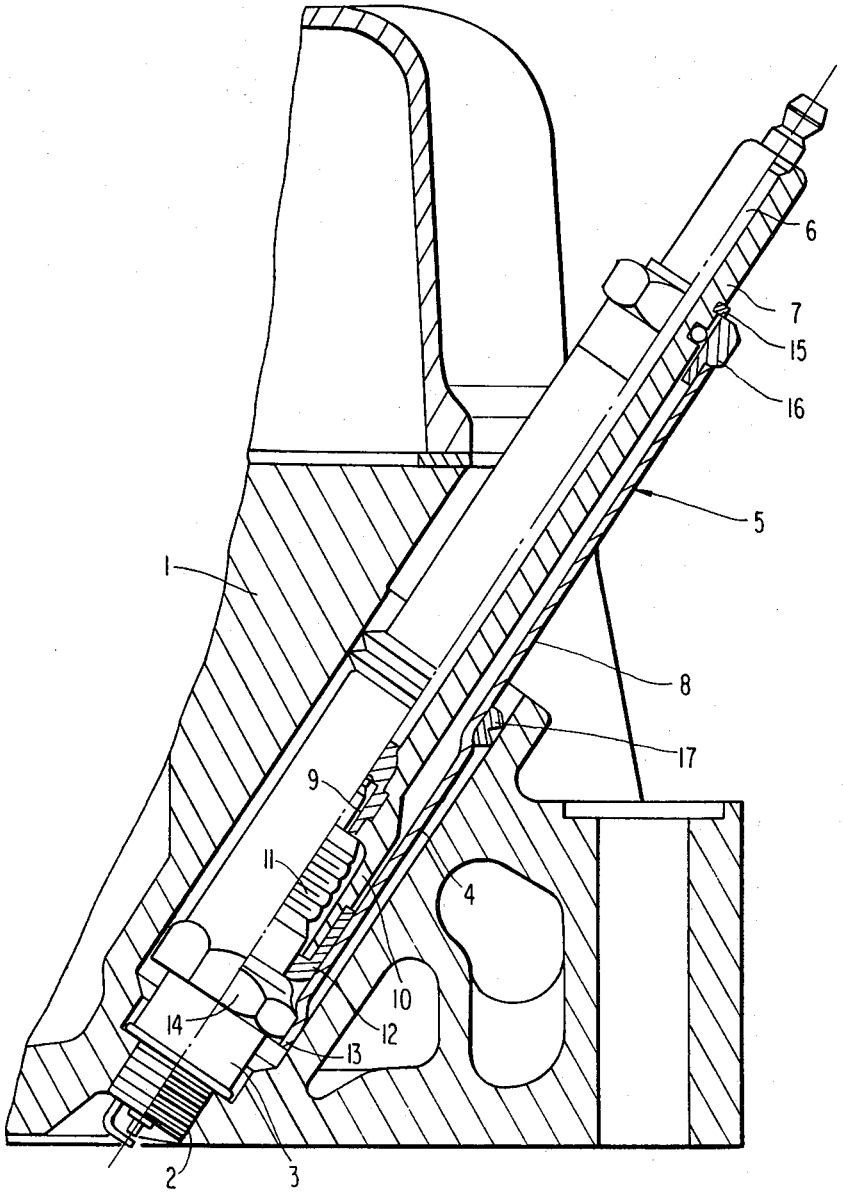

The present invention relates to a spark plug for internal combustion engines and, more particularly, to a spark plug adapted to be arranged deeply in a spark plug recess, with the spark plug having a polygonal mounting means, a center electrode, and an insulating body.

Accessibility to spark plugs is often quite problematic, especially in cases of internal combustion engines wherein the spark plugs are deeply housed or accommodated in spark plug niches or openings provided in the cylinder head. Moreover, additional difficulties may be encountered in electrically insulating and protecting the spark plugs against moisture and contamination.

The aim underlying the present invention essentially resides in providing a spark plug arrangement having an extension portion for facilitating insertion and removal thereof from an internal combustion engine.

In accordance with advantageous features of the present invention, the spark plug arrangement includes an extension which is adapted to be placed on the spark plug, with the extension including a center electrode, an insulating body, and a tubular jacket. The tubular jacket is provided at one end with an inner polygonal cross section corresponding to the polygonal cross section of the mounting means of the tubular jacket, with the other end of the spark plug being provided with a further polygonal mounting means. Advantageously, the mounting means on the spark plug and the mounting at the other end of the tubular jacket are of a hexagonal configuration.

By virtue of the above-noted features of the present invention, a spark plug is provided with an extension and has the characteristics of an externally-located spark plug with respect to the spark plug terminal and mounting means in spite of the deep location within a niche or opening accommodating the spark plug at the internal combustion engine.

Additionally, by virtue of the extension of the spark plug of the present invention, a threading of the spark plug into the hole accommodating the spark plug is possible manually at least for the initial threads and it is not necessary to utilize a special wrench such as a deep socket plug wrench. Moreover, when replacing the spark plug, it is normally necessary to exchange or replace the spark plug proper which is accommodated in the spark plug whole provided in the engine.

Advantageously, in accordance with further features of the present invention, the insulating body and the center electrode of the extension may be attached to the spark plug by a threaded connection between the center electrode of the extension and the center electrode of the spark plug proper. The tubular jacket is adapted to transmit tightening and releasing moments to the spark plug accommodated in the spark plug hole. Additionally, the tubular jacket may be attached to the insulating body of the extension by means of a mounting ring.

Preferably, the tubular jacket may be sealed in proximity of its two ends by sealing rings with respect to the insulating body of the spark plug and the insulating body of the extension.

Advantageously, a sealing ring, especially a lip-type sealing ring may be placed on the tubular jacket to seal the spark plug recess proper.

Accordingly, it is an object of the present invention to provide a spark plug for internal combustion engines which avoids, by simple means, shortcomings and disadvantages encountered in the prior art.

Another object of the present invention resides in providing a spark plug for internal combustion engines by which the insertion and removal of the spark plug is greatly facilitated.

A further object of the present invention resides in providing a spark plug for internal combustion engines which insures the existence of adequate electrical insulation as well as protection against moisture and other contamination.

Yet another object of the present invention resides in providing a spark plug for internal combustion engines which is simple in construction and therefore relatively inexpensive to manufacture.

A further object of the present invention resides in providing a spark plug for internal combustion engines which minimizes, if not avoids, the possibility of cross threading of the spark plug in the spark plug accommodating hole in the internal combustion engine.

Yet another object of the present invention resides in providing a spark plug for internal combustion engines which facilitates the alignment of the spark plug with respect to the spark plug accommodating hole in the engine.

Figure 2:
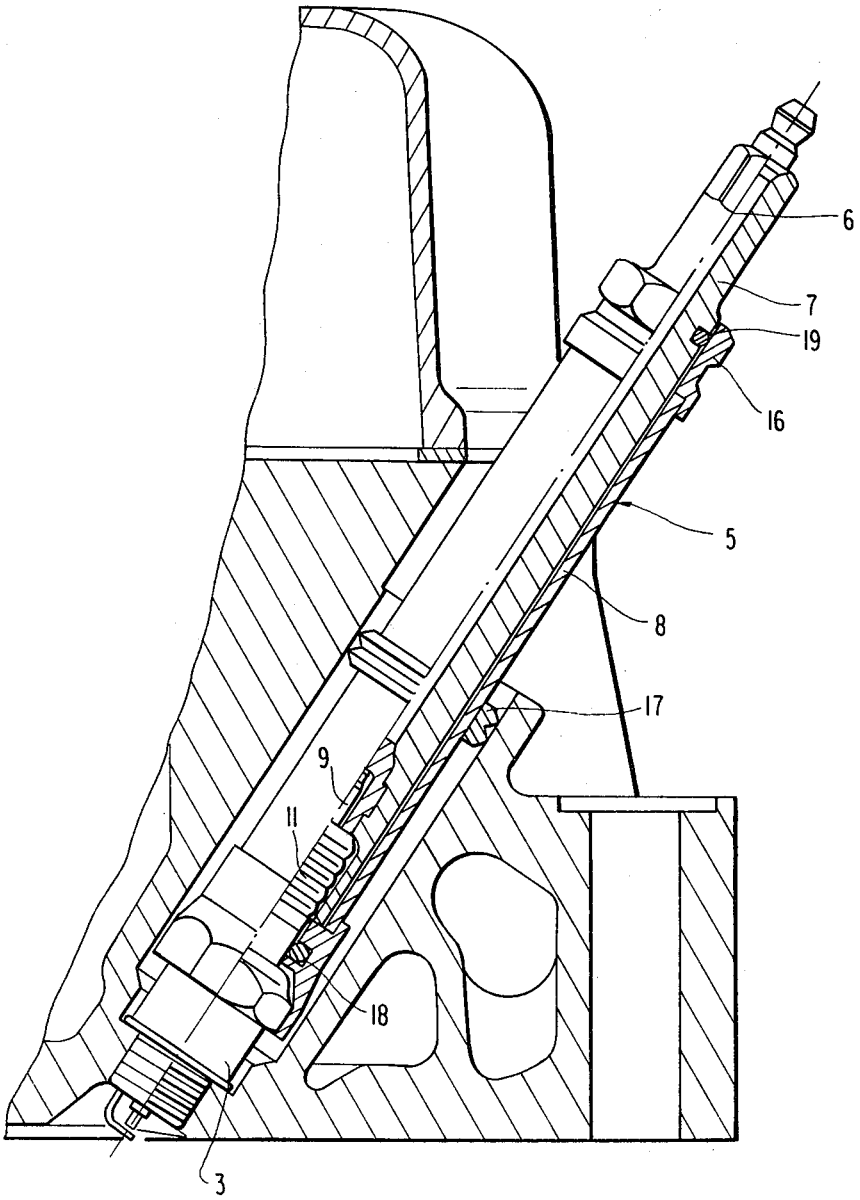

These and other objects, features and advantages of the present invention will become more apparent from the following description when taken in connection with the accompanying drawings which show, for the purposes of illustration only, two embodiments in accordance with the present invention, and wherein:

FIG. 1 is a partial cross-sectional view of an internal combustion engine having a spark plug in accordance with a first embodiment of the present invention mounted therein; and FIG. 2 is a partial cross-sectional view of an internal combustion engine having a spark plug in accordance with a second embodiment of the present invention mounted therein.

Referring now to the drawings, wherein like reference numerals are used in both views to designate like parts, and, more particularly, to FIG. 1, according to this figure, a cylinder head 1 of an internal combustion engine is provided with a spark plug bore 2 disposed at the end of a deep spark plug recess 4 with the bore 2 and recess 4 enabling an insertion of a spark plug 3 in the cylinder head 1. An extension generally designated by the reference numeral 5 is provided so as to render the spark plug 3 more accessible from outside of the spark plug recess 4.

As shown in FIG. 1, the extension 5 includes a centrally-disposed electrode 6, an insulating body 7, and a tubular jacket 8. The insulating body 7 is firmly connected with the center electrode 6, and the center electrode 6 is adapted to be connected to the center electrode 9 of the spark plug 3 by, for example, a threaded connection. The insulating body 7 includes a cylindrical extension 10 which extends over an insulating body 11 of the spark plug 3. A silicon seal 12 is attached to the lower end of the insulating body 7, with the seal contacting, on the one hand, the insulating body 11 of the spark plug 3, and, on the other hand, the tubular jacket 8 which is pushed over the insulating body 7 when the center electrode 6 has been connected to the center electrode 9.

A lower end of the tubular jacket is provided with an internal polygonal cross-sectional portion 13 which is adapted to extend over a corresponding polygonal mounting portion 14 of the spark plug 3. Advantageously, the mounting portions 13, 14 have a hexagonal configuration; however, as can readily be appreciated, the cross-sectional configuration of the mounting portion 13 would be determined by the configuration of the mounting portion 14 of the particular spark plug 3 being used in the engine.

A securing ring 15 fixedly secures the tubular jacket 8 to the insulating body 7. A mounting portion 16 is provided at the upper end of the tubular jacket 8 for enabling engagement with a suitable wrench such as, for example, a spark plug wrench. However, as can readily be appreciated, due to the free access to the spark plug provided by the extension portion, a suitable open end or a box-type wrench may also be utilized to insert and remove the spark plug 3. The mounting portion 16 advantageously has a hexagonal configuration. A lip-type sealing ring 17 is placed or mounted on the tubular jacket 8 in order to enable a sealing of the spark plug recess 4.

In order to replace the spark plug 3, the spark plug 3 and threadably-attached extension 5 are removed from the cylinder head 1 through the spark plug recess 4. The tubular jacket 8 is then detached from the spark plug 3 and from the insulating body 7 with the aid of the mounting or securing ring 15 so that the spark plug 3 may then be manually, for example, threadedly disconnected from the center electrode 6.

The spark plug of FIG. 2 differs with respect to the spark plug of FIG. 1 in that the tubular jacket 8 is sealed with respect to the insulating body 11 of the spark plug 3 by a sealing ring 18. Additionally, a further sealing ring 19 is provided in a zone of the mounting portion 16 for sealing the insulating body 7 of the extension 5 with respect to the mounting portion 16.

In the spark plug of FIG. 2, when mounting the extension 5, the spark plug 3 is placed into the tubular jacket 8 and thereupon the insulating body and center electrode 6 of the extension 5 is connected, for example, by a threaded connection, with the center electrode 9 of the spark plug 3.

While I have shown and described only two embodiments in accordance with the present invention, it is understood that the same is not limited thereto but is susceptible of numerous changes and modifications as known to one of ordinary skill in the art, and I therefore do not wish to be limited to the details shown and described herein but intend to cover all such changes and modifications obvious to one of ordinary skill in the art.

I claim:

1. An assembly for a spark plug deeply arranged in a spark plug recess provided in an intrnal combustion engine, the spark plug comprising a mounting portion, a center electrode means, and an insulating body, comprising extension means adapted to be attached to the spark plug for facilitating access thereto, the extension means includes a center electrode, an insulating means, and a tubular jacket with at a first end an inner cross-sectional configuration corresponding to a cross section of the mounting portion of the spark plug, and at a second end a mounting means, means for enabling an attachment of the insulating body and center electrode of the extension means to the spark plug, means for retaining the tubular jacket at the insulating means of the extension means, means for sealing the first end of the tubular jacket with respect to an insulating body of the spark plug, means for sealing the second end of the tubular jacket with respect to the insulating body of the extension means, and means for sealing the tubular body with respect to the spark plug recess.

2. An assembly according to claim 1, characterized in that the means for sealing the first and second ends of the tubular jacket include sealing rings respectively interposed between the tubular jacket and the insulating body of the spark plug and between the tubular jacket and the insulating body of the extension means.

3. An assembly according to claim 2, characterized in that the means for sealing the tubular body with respect to the spark plug recess includes a lip-type sealing ring attached to the tubular body.

4. An assembly according to claim 1, characterized in that the mounting portion of the spark plug and the mounting means provided on the second end of the tubular body portion have a hexagonal configuration.

5. An assembly according to claim 4, characterized in that the means for enabling an attachment of the insulating body and center electrode of the extension means includes a threaded connection means provided between the center electrode of the extension means and the center electrode of the spark plug.

6. An assembly according to claim 1, wherein the spark plug has a polygonal mounting portion thereon and the tubular jacket comprises means extending over the polygonal mounting portion for conforming the tubular jacket thereto.

7. An assembly according to claim 6, wherein the largest diameter of the extension means is equal to or less than the largest diameter of the spark plug mounting portion plus the diametral thickness at the point of the largest diameter of the spark plug of a socket wrench applicable thereto.

8. An assembly according to claim 1, wherein the insulating means conforms in removable fashion to the profile of the spark plug.

9. An assembly according to claim 1, wherein the spark plug has a polygonal mounting portion thereon and the tubular jacket further comprises means having the same size and polygonal configuration as said polygonal mounting portion for receiving a mounting tool.

10. An assembly according to claim 1, wherein the means for sealing the tubular body with respect to the spark plug recess is configured to facilitate alignment of the spark plug with respect to a spark plug accommodating hole in an engine block of the internal combustion engine.

11. An assembly according to claim 1, for use in the cylinder block of an internal combustion engine wherein the spark plug is mounted in the cylinder block and has a polygonal mounting portion thereon, and the tubular jacket comprises means extending over and removable from the spark plug as mounted in the cylinder block for conforming the tubular jacket to the polygonal mounting portion of the spark plug.

* * * * *